US008770307B2

(12) United States Patent
Hayashi et al.

(10) Patent No.: US 8,770,307 B2
(45) Date of Patent: Jul. 8, 2014

(54) BLADE CONTROL SYSTEM, CONSTRUCTION MACHINE AND BLADE CONTROL METHOD

(75) Inventors: Kazuhiko Hayashi, Komatsu (JP); Kenjiro Shimada, Komatsu (JP); Kenji Okamoto, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 267 days.

(21) Appl. No.: 13/267,037

(22) Filed: Oct. 6, 2011

(65) Prior Publication Data

US 2013/0087349 A1 Apr. 11, 2013

(51) Int. Cl.
*E02F 3/76* (2006.01)
*E02F 3/84* (2006.01)

(52) U.S. Cl.
USPC ..... 172/2

(58) Field of Classification Search
CPC ..... E02F 3/76; E02F 3/84; E02F 3/842; E02F 9/20; E02F 9/2246; E02F 9/2253; F16H 61/0213; F16H 61/14; F16H 63/00; F16H 63/40
USPC ..... 37/347, 348; 172/2–11, 40, 777, 812, 172/815, 821, 826, 831; 414/699, 700; 701/50
See application file for complete search history.

(56) References Cited

U.S. PATENT DOCUMENTS

| | | | | |
|---|---|---|---|---|
| 5,462,122 | A * | 10/1995 | Yamamoto et al. | 172/2 |
| 5,621,643 | A | 4/1997 | Nakagami et al. | |
| 5,694,317 | A * | 12/1997 | Nakagami et al. | 701/50 |
| 5,951,613 | A | 9/1999 | Sahm et al. | |
| 6,068,060 | A | 5/2000 | Ohtomo et al. | |
| 6,181,999 | B1 * | 1/2001 | Yamamoto et al. | 701/50 |

FOREIGN PATENT DOCUMENTS

| | | | |
|---|---|---|---|
| JP | 05-106239 | A | 4/1993 |
| JP | 5-106239 | A | 4/1993 |
| JP | 10-141955 | A | 5/1998 |
| JP | 10-147953 | A | 6/1998 |
| JP | 11-256620 | A | 9/1999 |
| JP | 2001-107385 | A | 4/2001 |

OTHER PUBLICATIONS

International Search Report of corresponding PCT Application No. PCT/JP2012/073137 dated Dec. 18, 2012.

* cited by examiner

*Primary Examiner* — Robert Pezzuto
(74) *Attorney, Agent, or Firm* — Global IP Counselors, LLP

(57) ABSTRACT

A blade control system of the present invention includes a determining part which is configured to determine whether or not a load acting on a blade exceeds a first threshold, and a tilt controlling part which is configured to supply a hydraulic oil to a tilt cylinder for causing the blade to perform a rightward tilt action and a leftward tilt action when the determining part determines that the load acting on the blade exceeds the first threshold.

10 Claims, 7 Drawing Sheets

BLADE CONTROL SYSTEM, CONSTRUCTION MACHINE AND BLADE CONTROL METHOD

BACKGROUND

1. Technical Field

The present invention relates to a blade control system, a construction machine and a blade control method.

2. Description of the Related Art

Well-known dozing controls, having been proposed for construction machines (e.g., bulldozers or motor graders), are intended to efficiently execute a dozing operation and are configured to automatically regulate the vertical position of a blade for keeping load acting on the blade (hereinafter referred to as "blade load") at a target value (e.g., see Japan Laid-open Patent Application Publication No. JP-A-H05-106239).

SUMMARY

However, when a dozing operation is executed with the method described in the publication No. JP-A-H05-106239, since the blade is configured to be elevated every time the blade load exceeds the target value and a wavy dozed surface is formed in a side view, it is difficult to smoothly grade the dozed surface.

The present invention has been produced in view of the above drawback and is intended to provide a blade control system, a construction machine and a blade control method for inhibiting the dozed surface from being dozed in a wavy shape.

A blade control system according to a first aspect of the present invention includes a lift frame vertically pivotably attached to a vehicle body; a blade attached to a tip of the lift frame; a tilt cylinder connected to the lift frame and the blade, the tilt cylinder configured to cause the blade to perform a rightward tilt action and a leftward tilt action; a determining part configured to determine whether or not a load acting on the blade exceeds a first threshold; and a tilt controlling part configured to supply a hydraulic oil to the tilt cylinder for causing the blade to perform the rightward tilt action and the leftward tilt action when the determining part determines that the load acting on the blade exceeds the first threshold. It should be noted that the rightward tilt action herein refers to an action of positioning the right bottom end of the blade lower than the left bottom end thereof in a view from an operator's seat, whereas the leftward tilt action herein refers to an action of positioning the left bottom end of the blade lower than the right bottom end thereof in a view from the operator's seat.

According to the blade control system of the first aspect of the present invention, since the right bottom end of the blade is positioned lower than the left bottom end thereof in performing the rightward tilt action, the right side of the vehicle body is thereby instantly lifted up, whereas since the left bottom end of the blade is positioned lower than the right bottom end thereof in performing the leftward tilt action, the left side of the vehicle body is thereby instantly lifted up. It is thus possible to reduce the blade load equally for both the right and left sides by a small amount, then the blade load equally recued for the right and left sides. Therefore, the dozed surface can be further inhibited from being formed in a wavy shape than a case that the blade load is regulated by the lift control of the blade.

A blade control system according to a second aspect of the present invention relating to the first aspect further includes a tilt action time setting part configured to set an execution time of causing the blade to perform the rightward tilt action and the leftward tilt action to be longer in proportion to magnitude of the load, wherein the tilt controlling part is configured to cause the blade to perform the rightward tilt action and the leftward tilt action in accordance with the execution time set by the tilt action time setting part.

According to the blade control system of the second aspect of the present invention, since the rightward tilt action and the leftward tilt action are executed for a longer period of time in proportion to magnitude of the blade load, it is possible to efficiently reduce the blade load.

A blade control system according to a third aspect of the present invention further includes a proportional control valve configured to supply the hydraulic oil to the tilt cylinder; and an open ratio setting part configured to set an open ratio of the proportional control valve based on the load, wherein the open ratio setting part is configured to set the open ratio to be greater in proportion to magnitude of the load, and the tilt controlling part is configured to control the proportional control valve in accordance with the open ratio set by the open ratio setting part.

According to the blade control system of the third aspect of the present invention, since it is possible to increase the speed of the rightward tilt action and that of the leftward tilt action in proportion to magnitude of the blade load, it is possible to efficiently reduce the blade load.

A blade control system according to a fourth aspect of the present invention relating to one of the first to third aspects further includes a theoretical vehicle speed obtaining part configured to obtain a theoretical vehicle speed of the vehicle body; an actual vehicle speed obtaining part configured to obtain an actual vehicle speed of the vehicle body; a lift cylinder configured to vertically pivot the lift frame; and a lift controlling part configured to supply the hydraulic oil to the lift cylinder for elevating the blade when a ratio of the actual vehicle speed to the theoretical vehicle speed is less than a second threshold.

According to the blade control system of the fourth aspect of the present invention, since elevation of the blade is configured to be executed in addition to the rightward and leftward tilt actions when excessive shoe slippage abruptly occurs due to change of the road surface condition, it is possible to promptly inhibit occurrence of shoe slippage.

A blade control system according to a fifth aspect of the present invention relating to one of the first to fourth aspects further includes a turning direction detector configured to detect a turning direction of the vehicle body based on a yaw angle of the vehicle body, wherein the tilt controlling part is configured to cause the blade to start performing the rightward tilt action first when the turning direction detector detects that the turning direction of the vehicle body is left, and the tilt controlling part is configured to cause the blade to start performing the leftward tilt action first when the turning direction detector detects that the turning direction of the vehicle body is right.

According to the blade control system of the fifth aspect of the present invention, it is possible to correct orientation of the vehicle body displaced from the travel direction on the onset of the tilt action.

A construction machine according to a sixth aspect of the present invention includes a vehicle body and the blade control system according to one of the first to fifth aspects of the present invention.

A construction machine according to a seventh aspect of the present invention relating to the sixth aspect further includes a drive unit including a pair of tracks attached to the vehicle body.

A blade control method according to an eighth aspect of the present invention includes: determining whether or not a load, which acts on a blade attached to a tip of a lift frame vertically pivotably attached to a vehicle body, exceeds a first threshold; and causing the blade to alternately perform a rightward tilt action and a leftward tilt action when the load acting on the blade is determined to exceed the first threshold.

A blade control method according to a ninth aspect of the present invention relating to the eighth aspect further includes causing the blade to perform the rightward tilt action and the leftward tilt action at a tilt range to be increased in proportion to magnitude of the load.

A blade control method according to a tenth aspect of the present invention relating to one of the eighth and ninth aspects further includes causing the blade to perform the rightward tilt action and the leftward tilt action at a tilt speed to be increased in proportion to magnitude of the load.

BRIEF DESCRIPTION OF THE DRAWINGS

Referring now to the attached drawings which form a part of this original disclosure.

DETAILED DESCRIPTION OF THE EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

With reference to attached figures, a bulldozer will be hereinafter explained as an exemplary "construction machine". In the following explanation, the terms "up", "down", "front", "rear", "right" and "left" and their related terms should be understood as directions seen from an operator seated on an operator's seat.

Overall Structure of Bulldozer 100

Figure 1:
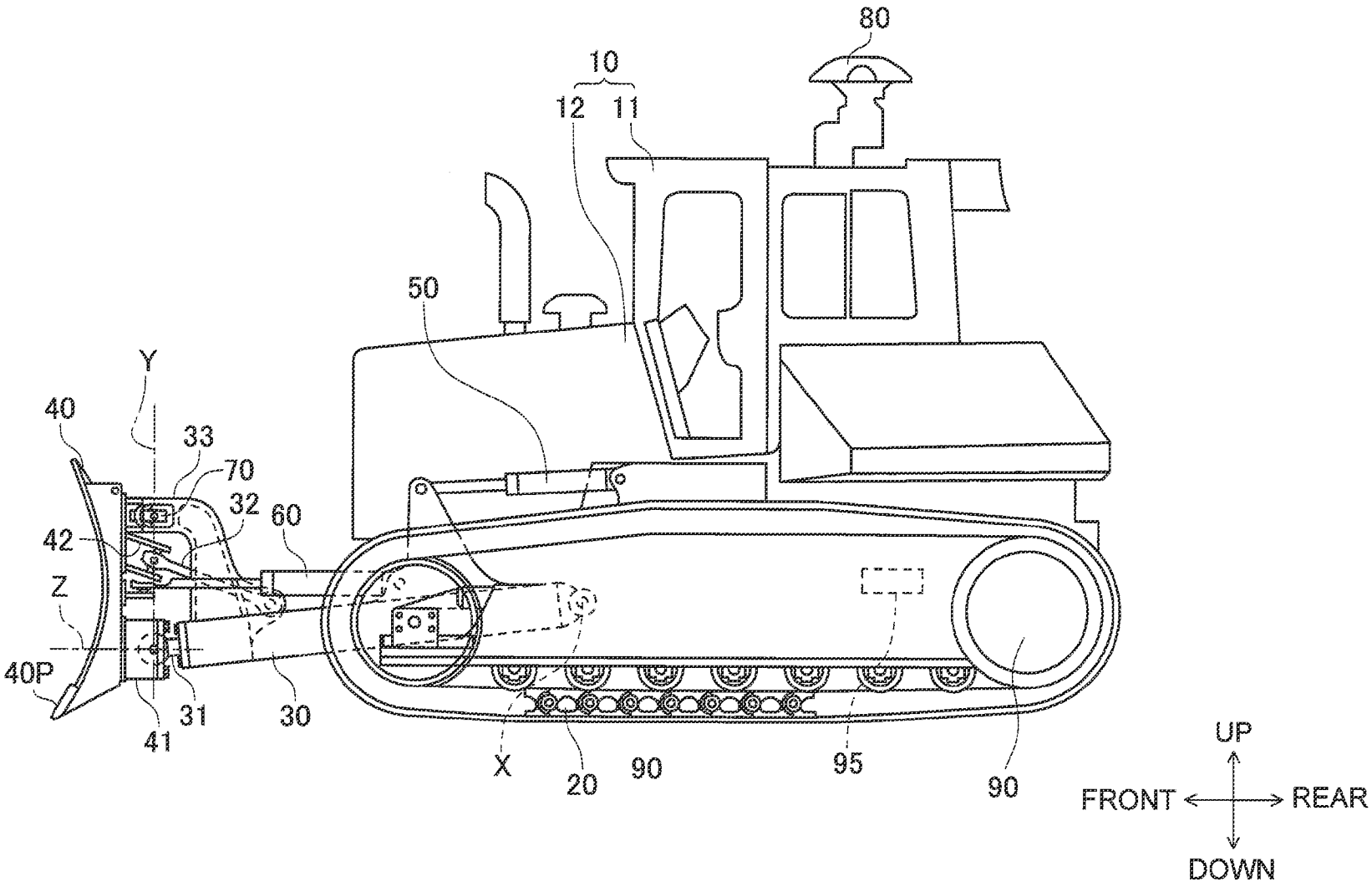
FIG. 1 is a side view of the entire structure of a bulldozer.

FIG. 1 is a side view of the entire structure of a bulldozer 100 according to an exemplary embodiment of the present invention.

The bulldozer 100 includes a vehicle body 10, a drive unit 20, a lift frame 30, a blade 40, a lift cylinder 50, an angling cylinder 60, a tilt cylinder 70, a GPS receiver 80, a pair of sprocket wheels 90 and a driving torque sensor 95. Further, the bulldozer 100 is embedded with a blade control system 200. The structure and actions of the blade control system 200 will be hereinafter described.

The vehicle body 10 includes a cab 11 and an engine compartment 12. Although not illustrated in the figures, the cab 11 is equipped with a seat and a variety of operating devices. The engine compartment 12 is disposed forwards of the cab 11 for accommodating an engine (not illustrated in the figures).

The drive unit 20 is formed by a pair of tracks (only the left-side one is illustrated in FIG. 1), and the drive unit 20 is attached to the bottom of the vehicle body 10. The drive unit 20 is configured to be rotated by the pair of sprocket wheels 90.

The lift frame 30 is disposed inwards of the drive unit 20 in the right-and-left direction of the bulldozer 100. The lift frame 30 is attached to the vehicle body 10 while being up-and-down directionally pivotable about a lift axis X arranged in parallel to the right-and-left direction of the bulldozer 100. The lift frame 30 supports the blade 40 through a ball-and-socket joint 31, a pitching support link 32 and a bracing strut 33.

The blade 40 is disposed forwards of the vehicle body 10. The blade 40 is supported by the tip of the lift frame 30 through a universal coupling 41 and a pitching coupling 42. The universal coupling 41 is coupled to the ball-and-socket joint 31, whereas the pitching coupling 42 is coupled to the pitching support link 32. The blade 40 is configured to be lifted up or down in conjunction with upward or downward pivot of the lift frame 30. The blade 40 includes a cutting edge 40P on the bottom end thereof. The cutting edge 40P is shoved into the ground in dozing or grading.

The lift cylinder 50 is coupled to the vehicle body 10 and the lift frame 30. In conjunction with extension or contraction of the lift cylinder 50, the lift frame 30 is configured to pivot up and down about the lift axis X.

The angling cylinder 60 is coupled to the lift frame 30 and the blade 40. In conjunction with extension or contraction of the angling cylinder 60, the blade 40 is configured to be tilted about an angle axis Y passing through the rotary center of the universal coupling 41 and that of the pitching coupling 42.

The tilt cylinder 70 is coupled to the bracing strut 33 of the lift frame 30 and the right upper end of the blade 40. In conjunction with extension or contraction of the tilt cylinder 70, the blade 40 is configured to pivot about a tilt axis Z arranged perpendicular to both of the lift axis X and the angle axis Y. In the present exemplary embodiment, an action of the blade 40 pivoting about the tilt axis Z will be hereinafter simply referred to as "a tilt action". The tilt action includes a rightward tilt action and a leftward tilt action. Specifically, the rightward tilt action refers to a vertically clockwise tilt action for positioning the right bottom end of the blade 40 lower than the left bottom end thereof in a view from the operator's seat, whereas the leftward tilt action refers to a vertically counter-clockwise tilt action for positioning the left bottom end of the blade 40 lower than the right bottom end thereof.

The GPS receiver 80 is disposed on the vehicle body 10. The GPS receiver 80 is a GPS (Global Positioning System) antenna. The GPS receiver 80 is configured to receive GPS data indicating the global position thereof. The GPS receiver 80 is configured to transmit the received GPS data to a blade controller 210 (see FIG. 2) to be described.

The pair of sprocket wheels 90 is configured to be driven by an engine (not illustrated in the figures). The drive unit 20 is configured to be rotated by the pair of sprocket wheels 90.

The driving torque sensor 95 is configured to obtain driving torque data indicating driving torque of the pair of sprocket wheels 90. The driving torque sensor 95 is configured to transmit the obtained driving torque data to the blade controller 210.

Structure of Blade Control System 200

Figure 2:
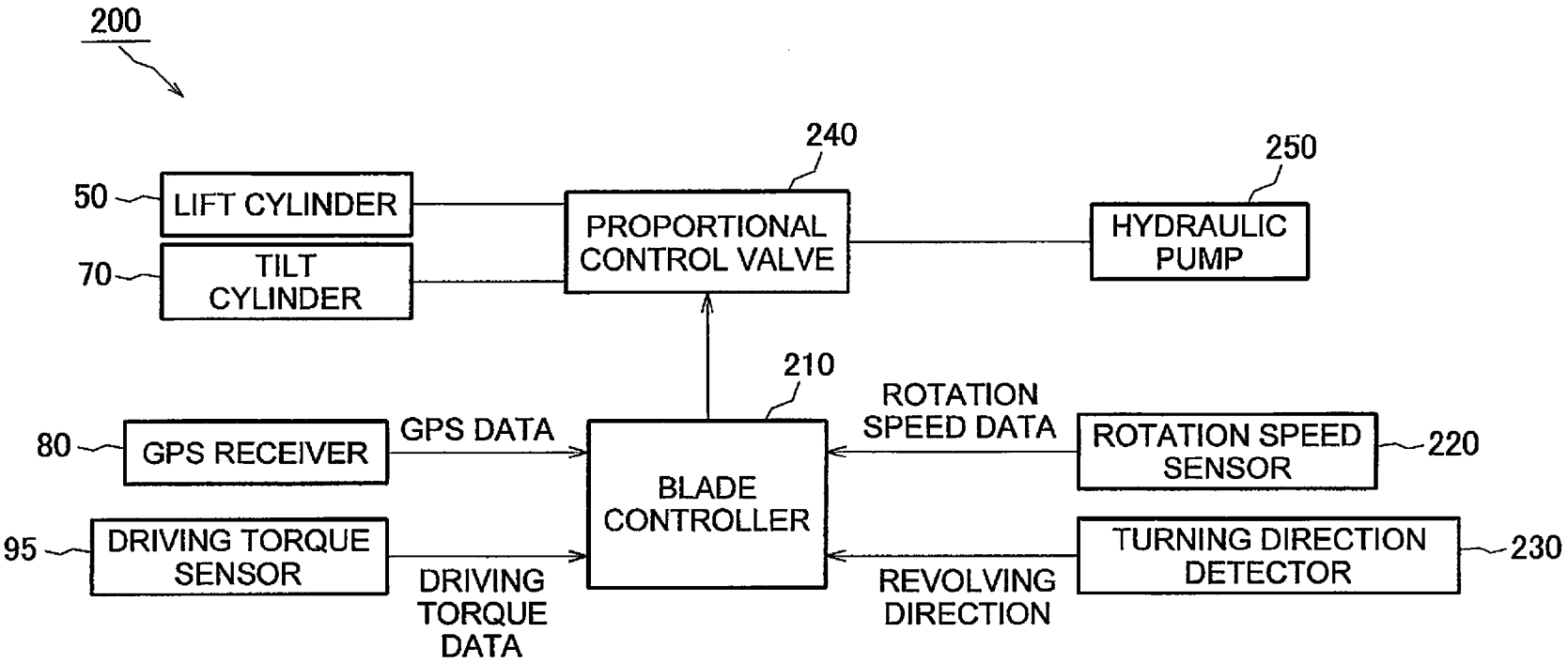
FIG. 2 is a configuration block diagram of a blade control system.

FIG. 2 is a configuration block diagram of the blade control system 200 according to the present exemplary embodiment.

The blade control system 200 includes the lift frame 30, the blade 40, the lift cylinder 50, the blade controller 210, a rotation speed sensor 220, a steering direction detector 230, a proportional control valve 240 and a hydraulic pump 250.

The rotation speed sensor 220 is configured to detect the rotation speed of the pair of sprockets wheels 90. The rotation speed sensor 220 is configured to transmit rotation speed data indicating the rotation speed of the pair of sprocket wheels 90 to the blade controller 210.

The steering direction detector 230 is configured to detect the steering direction of the vehicle body 10 based on a yaw angle of the vehicle body 10 detected by a gyro sensor. The yaw angle of the vehicle body 10 refers to an angle displaced rightwards/leftwards from a travel direction set by a directional operating tool (e.g., a steering wheel). The steering direction detector 230 is configured to transmit the detected steering direction to the blade controller 210.

The blade controller 210 is configured to output a command value to the proportional control valve 240 based on the rotation speed data received from the rotation speed sensor 220, the steering direction received from the steering direction detector 230, the GPS data received from the GPS receiver 80 and the driving torque data received from the driving torque sensor 95. Functions and actions of the blade controller 210 will be hereinafter described.

The proportional control valve 240 is disposed between the lift cylinder 50 and the hydraulic pump 250 and between the tilt cylinder 70 and the hydraulic pump 250. The opening ratio of the proportional control valve 240 is configured to be controlled by the command value outputted from the blade controller 210.

The hydraulic pump 250 is configured to be operated in conjunction with the engine, and is configured to supply hydraulic oil to the lift cylinder 50 and the tilt cylinder 70 via the proportional control valve 240.

Functions of Blade Controller 210

Figure 3:
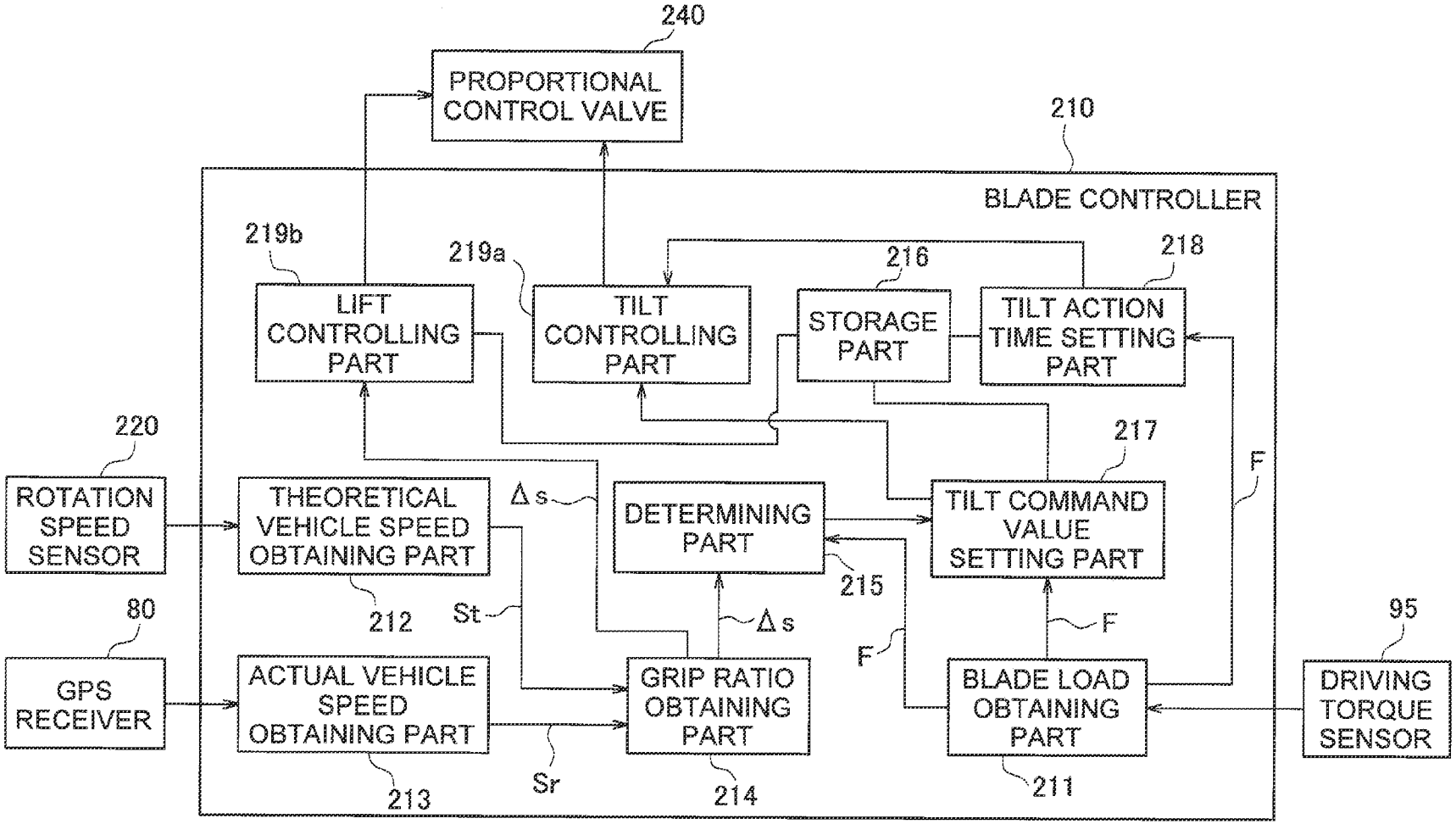
FIG. 3 is a functional block diagram of a blade controller.

FIG. 3 is a functional block diagram of the blade controller 210.

As represented in FIG. 3, the blade controller 210 includes a blade load obtaining part 211, a theoretical vehicle speed obtaining part 212, an actual vehicle speed obtaining part 213, a grip ratio obtaining part 214, a determining part 215, a storage part 216, a tilt command value setting part 217, a tilt action time setting part 218, a tilt controlling part 219*a* and a lift controlling part 219*b*.

The blade load obtaining part 211 is configured to calculate a load acting on the blade 40 (hereinafter referred to as "a blade load F") based on the driving torque data received from the driving torque sensor 95. The blade load can be referred to as either "dozing resistance" or "traction force".

The theoretical vehicle speed obtaining part 212 is configured to calculate a theoretical vehicle speed St based on the rotation speed data received from the rotation speed sensor 220. The theoretical vehicle speed St is an estimated value of the vehicle speed of the bulldozer 100.

The actual vehicle speed obtaining part 213 is configured to calculate an actual vehicle speed Sr of the bulldozer 100 based on the GPS data obtained from the GPS receiver 80. The actual vehicle speed Sr is an actually measured value of the vehicle speed of the bulldozer 100.

The grip ratio obtaining part 214 is configured to calculate a grip ratio ΔS (%) by dividing the actual vehicle speed Sr by the theoretical vehicle speed St. In other words, the grip ratio ΔS is a ratio of the actual vehicle speed Sr to the theoretical vehicle speed St, and the relation "ΔS=Sr/St" is herein established. The grip ratio ΔS is an index for indicating a grad of slippage of the drive unit 20 against the ground. The grip ratio ΔS is reduced in proportion to magnitude of shoe slippage. It should be noted that shoe slippage occurs in a normal operation, whereas excessive shoe slippage occurs the driving force of the drive unit 20 cannot be appropriately transferred to the ground due to an excessively increased slippage amount.

The determining part 215 is configured to determine whether or not the blade load F is greater than 0.55 W (note W is the vehicle weight of the bulldozer 100) and whether or not the grip ratio ΔS is less than or equal to 70%, and simultaneously, the blade load F is greater than 0.3 W. It should be noted that such various thresholds used by the determining part 215 may be arbitrarily set.

The storage part 216 stores a variety of information used for controls by the blade controller 210. Specifically, the storage part 216 stores maps represented in FIGS. 4 to 6. The map of FIG. 4 contains a tilt command value curve G1 for setting a tilt command value based on the blade load F and is configured to be used by the tilt command value setting part 217. The map of FIG. 5 contains a gain curve G2 for setting time-series transition of gain to be multiplied for the tilt command value and is configured to be used by the tilt controlling part 219*a*. The map 3 of FIG. 6 contains a lift command value curve G3 for setting a lift command value based on the grip ratio ΔS and is configured to be used by the lift controlling part 219*b*.

Figure 4:
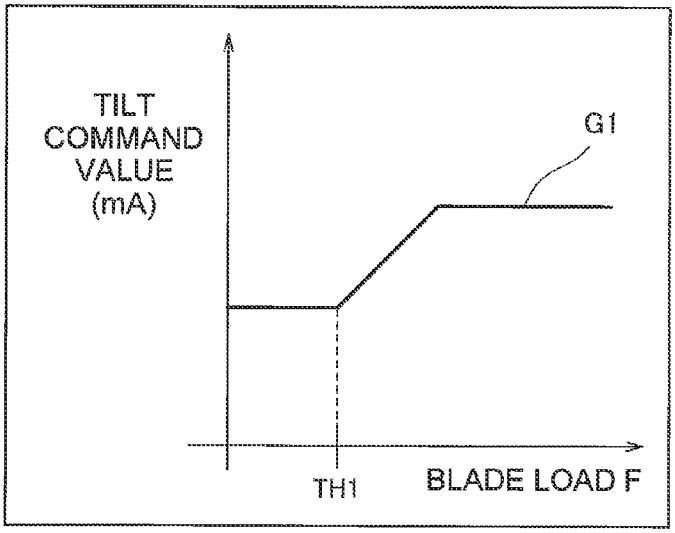
FIG. 4 is a map representing relation between blade load F and tilt command value.

The tilt command value setting part 217 (an exemplary opening ratio setting part) is configured to set the tilt command value based on the blade load F with reference to the map of FIG. 4. As represented in the map of FIG. 4, the tilt command value setting part 217 is configured to fix the tilt command value to be the minimum value when the blade load F is less than a load threshold TH1 (an exemplary first load), whereas the tilt command value setting part 217 is configured to set the tilt command value to be increased in response to increase in the blade load F when the blade load F is greater than or equal to the load threshold TH1. Further, as represented in the map of FIG. 4, the tilt command value setting part 217 is configured to fix the tilt command value to be the maximum value when the blade load F is greater than or equal to a predetermined value. It should be noted that the tilt command value corresponds to the opening ratio of the proportional control valve 240 and the tilt speed of the blade 40 gets faster in response to magnitude of the blade load F. It should be noted that the tilt speed herein refers to a moving speed of the blade 40 in either the rightward tilt action or the leftward tilt action.

It should be also noted that the load threshold TH1 can be set based on the blade load required for elevating the blade to avoid excessive shoe slippage. Because of this incident, since the rightward/leftward tilt action is thereby configured to be executed before elevation of the blade 40, it is possible to inhibit the dozed surface from being formed in a wavy shape.

The tilt action time setting part 218 is configured to set a period of time for executing the tilt action (hereinafter referred to as "a tilt action time") based on the blade load F.

For example, the tilt action time setting part 218 is configured to set the tilt action time to be two seconds when the blade load F is greater than 0.65 W, and otherwise, set the tilt action time to be one second. Further, the tilt action time setting part 218 may be configured to set the tilt action time to be gradually longer in proportion to magnitude of the blade load F. It should be noted that the tilt action time corresponds to the length of the horizontal axis (time axis) in the map of FIG. 5, and a tilt range of the blade 40 is increased in proportion to length of the tilt action time. The tilt range herein refers to a difference in the vertical position of the right bottom end of the blade 40 and that in the vertical position of the left bottom end of the blade 40.

Figure 5:
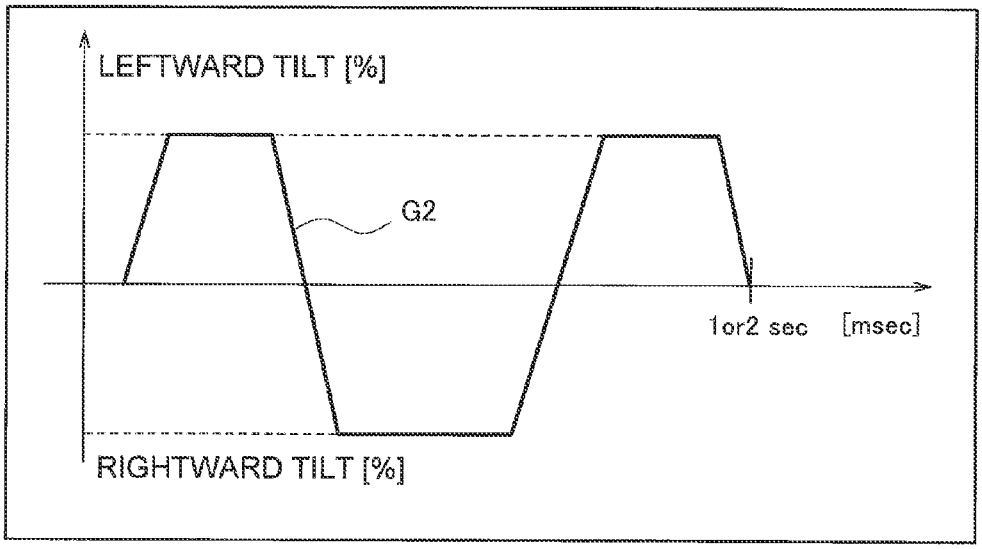
FIG. 5 is a map for setting time-series transition in gain of the tilt command value.

With reference to the map of FIG. 5, the tilt controlling part 219*a* is configured to set time-series transition of the tilt command value based on the gain curve G2, the tilt command value set by the tilt command value setting part 217 and the tilt action time set by the tilt action time setting part 218. Further, the tilt controlling part 219*a* is configured to determine which of the rightward tilt action and the leftward tilt action should be performed first based on the turning direction detected by the turning direction detector 230. Specifically, the tilt controlling part 219*a* is configured to perform the rightward tilt action first during the leftward turning, whereas the tilt controlling part 219*a* is configured to perform the leftward tilt action first during either the rightward turning or straight travelling of the bulldozer 100. The tilt controlling part 219*a* is configured to output the tilt command value to the proportional control valve 240 in accordance with the set time-series transition of the tilt command value.

Figure 6:
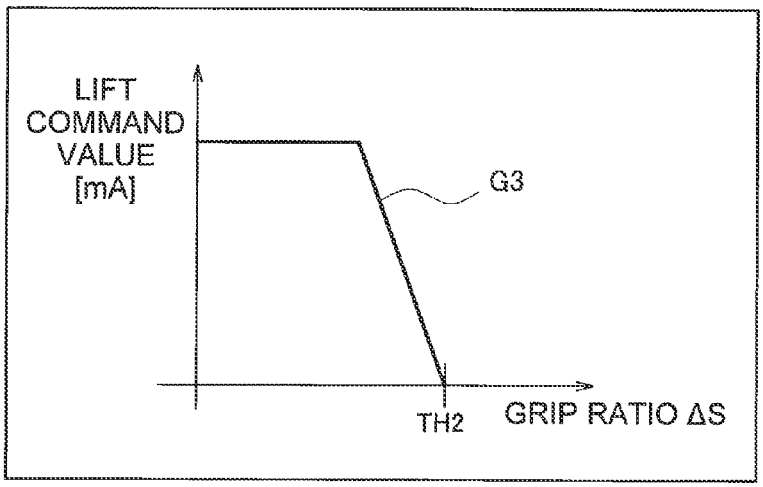
FIG. 6 is a map representing relation between grip ratio ΔS and lift command value.

The lift controlling part 219*b* is configured to set the lift command value based on the grip ratio ΔS with reference to the map of FIG. 6. As represented in the map of FIG. 6, the lift controlling part 219*b* is configured to set the lift command value to be increased as the grip ratio ΔS gets smaller than a grip threshold TH2 (an exemplary second threshold), whereas the lift controlling part 219*b* is configured to fix the lift command value to be the maximum value when the grip ratio ΔS is less than or equal to a predetermined value. It should be noted that the lift command value corresponds to the open ratio of the proportional control valve 240 and the lift speed of the blade 40 gets faster in inverse proportion to magnitude of the grip ratio ΔS. The lift speed herein refers to the elevation speed of the blade 40.

Actions of Blade Controller 210

Figure 7:
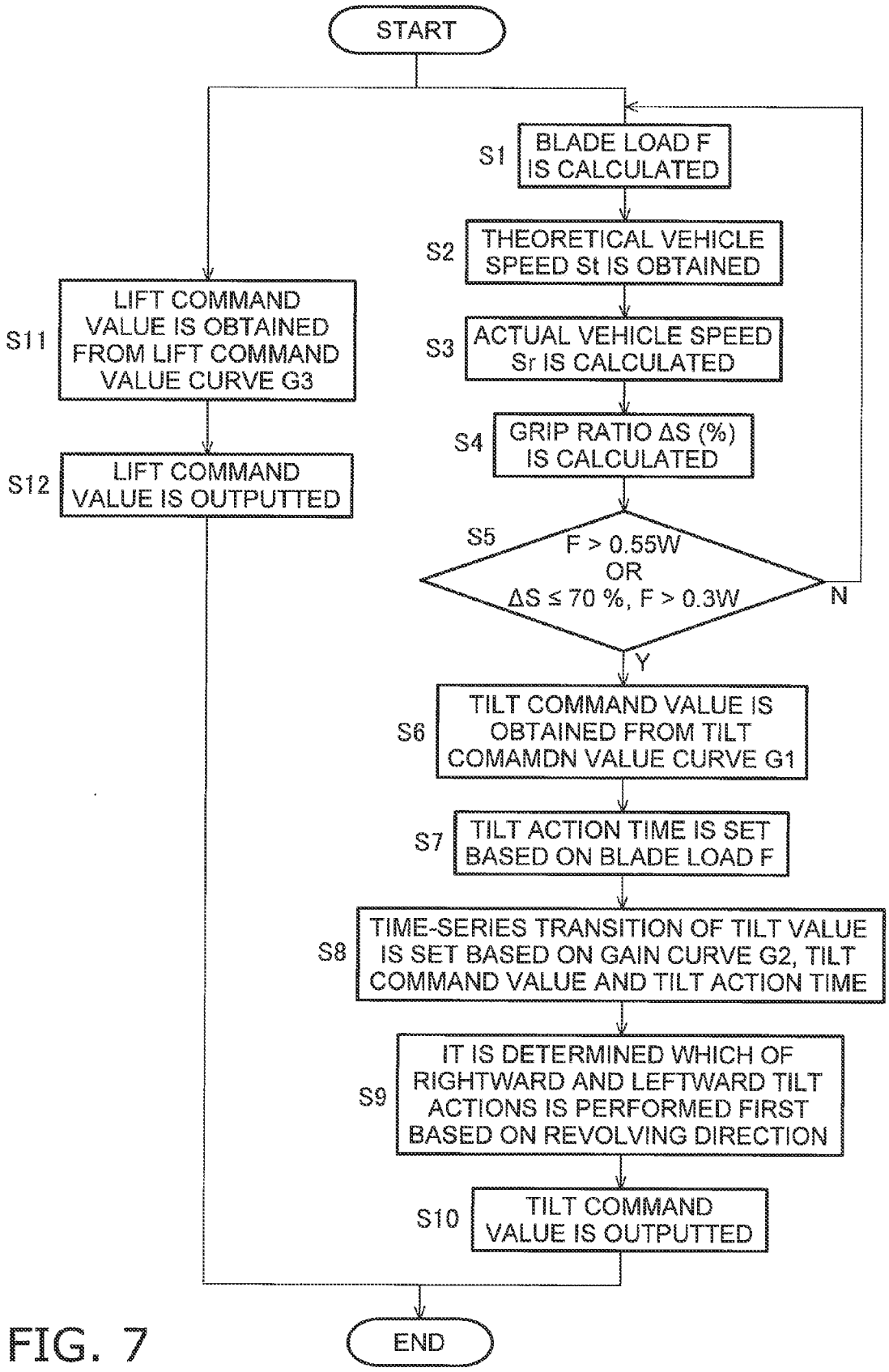
FIG. 7 is a flowchart for explaining actions of the blade controller.

FIG. 7 is a flowchart for explaining actions of the blade controller 210.

First in Step S1, the blade controller 210 calculates the blade load F based on the driving torque data obtained from the driving torque sensor 95.

Next in Step S2, the blade controller 210 obtains the theoretical vehicle speed St from the rotation speed sensor 220.

Next in Step S3, the blade controller 210 calculates the actual vehicle speed Sr of the bulldozer 100 based on the GPS data obtained from the GPS receiver 80.

Next in Step S4, the blade controller 210 calculates the grip ratio ΔS (%) by dividing the actual vehicle speed Sr by the theoretical vehicle speed St.

Next in Step S5, the blade controller 210 determines the following conditions of: whether or not the blade load F is greater than 0.55 W; and whether or not the grip ratio ΔS is less than or equal to 80% and the blade load F is greater than 0.3 W. The processing proceeds to Step S6 when either of the conditions is satisfied. By contrast, the processing returns to Step S1 when neither of the conditions is satisfied.

Next in Step S6, the blade controller 210 sets the tilt command value based on the blade load F with reference to the tilt command value curve G1 represented in FIG. 4. It should be noted that since the proportional control valve 240 cannot be driven by the tilt command value (mA) where the blade load F is less than the load threshold TH1, the blade 40 is caused to perform the tilt action only when the blade load F is greater than the load threshold TH1.

Next in Step S7, the blade controller 210 sets the tilt action time in accordance with magnitude of the blade load F. Specifically, the blade controller 210 sets the tilt action time to be longer in proportion to magnitude of the blade load F. In the present exemplary embodiment, the tilt action time is set to be two seconds when the blade load F is greater than 0.65 W, whereas the tilt action time is set to be one second when the blade load F is less than or equal to 0.65 W. Accordingly, the tilt range is increased in proportion to magnitude of the blade load F.

Next in Step S8, the blade controller 210 sets time-series transition of the tilt command value with reference to the gain curve G2 represented in FIG. 5 based on the tilt command value set by the tilt command value setting part 217 and the tilt action time set by the tilt action time setting part 218.

Next in Step S9, the blade controller 210 determines which of the rightward tilt action and the leftward tilt action should be performed first based on the steering direction detected by the steering direction detector 230. The blade controller 210 determines that the rightward tilt action is performed first during leftward turning, whereas the blade controller 210 determines that the leftward tilt action is performed first during either rightward turning or straight traveling.

Next in Step S10, the blade controller 210 outputs the tilt command value to the proportional control valve 240 in accordance with the time-series transition of the tilt command value set in Step S9. Accordingly, the blade 40 is caused to alternately perform the rightward tilt action and the leftward tilt action once either when the blade load F is greater than the load threshold TH1 or when excessive shoe slippage occurs in the drive unit 20.

Further, the blade controller 210 executes a control of the lift cylinder 50 simultaneously with the aforementioned Steps S5 to S10.

In Step S11, the blade controller 210 obtains the lift command value based on the grip ratio ΔS with reference to the lift command value curve G3 represented in FIG. 6. According to the lift command value curve G3, the lift command value is set to be increased as the grip ratio ΔS gets smaller than the grip threshold TH2. Therefore, a higher elevation command value is given in proportion to excessiveness of shoe slippage in the drive unit 20.

Next in Step S12, the blade controller 210 outputs the lift command value obtained in Step S11 to the proportional control valve 240. Accordingly, the blade 40 is elevated when excessive shoe slippage occurs in the drive unit 20.

Working Effects (1) In the present exemplary embodiment, the blade controller 210 is configured to cause the blade 40 to alternately perform the rightward tilt action and the leftward tilt action once when the blade load F is greater than the load threshold TH1.

With this tilt action, since the right side of the vehicle body is instantly lifted up in the rightward tilt action, whereas the left side of the vehicle body is instantly lifted up in the leftward tilt action, the blade load F can be equally reduced for both the right and left sides by a slight amount. Due to the blade load F equally reduced for both the right and left sides, the dozed surface can be further inhibited from being formed in a wavy shape than a case that the blade load F is regulated by the lift control of the blade 40.

Figure 8:
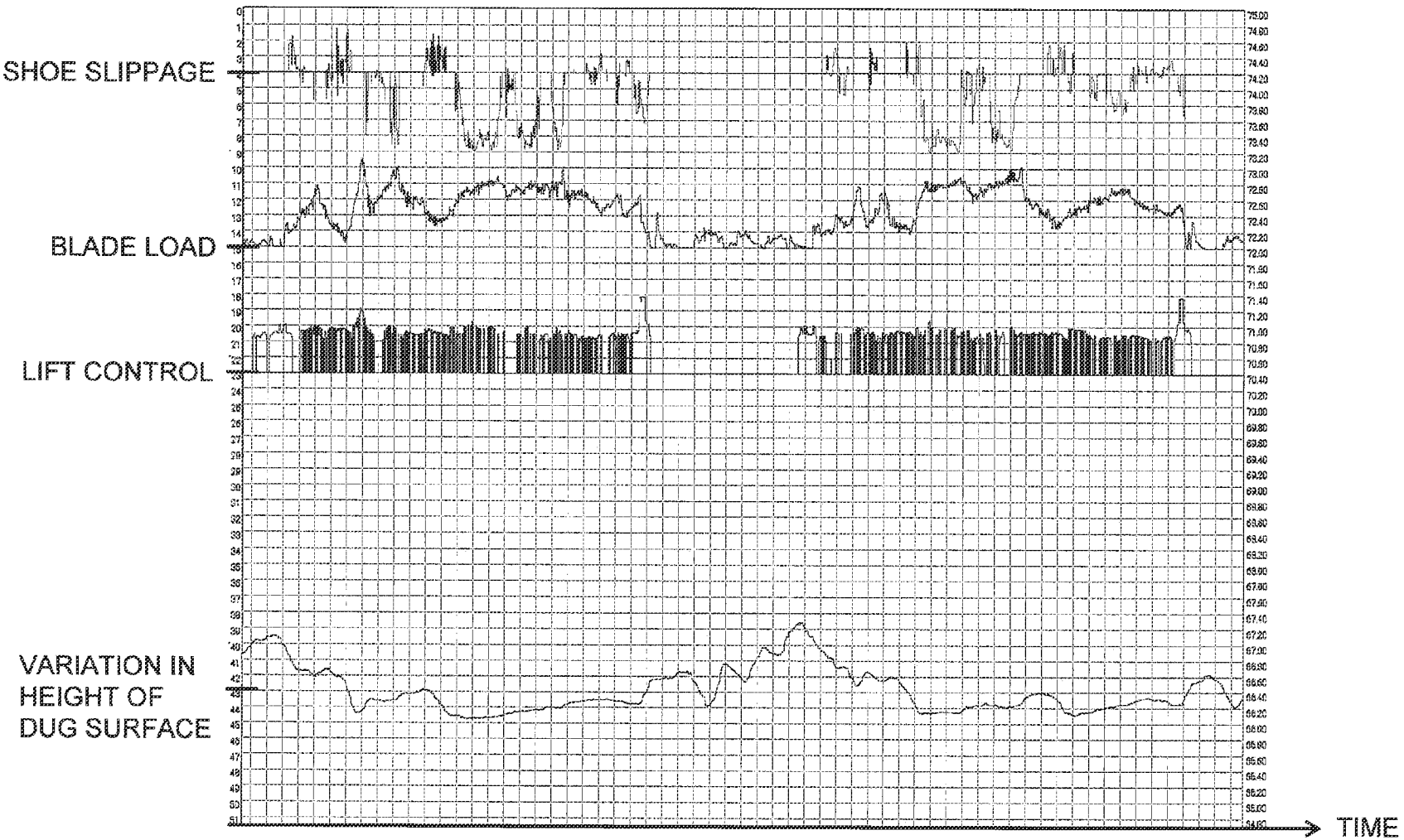
FIG. 8 is a chart representing variation in height of a dozed surface in dozing with a lift control.
Figure 9:
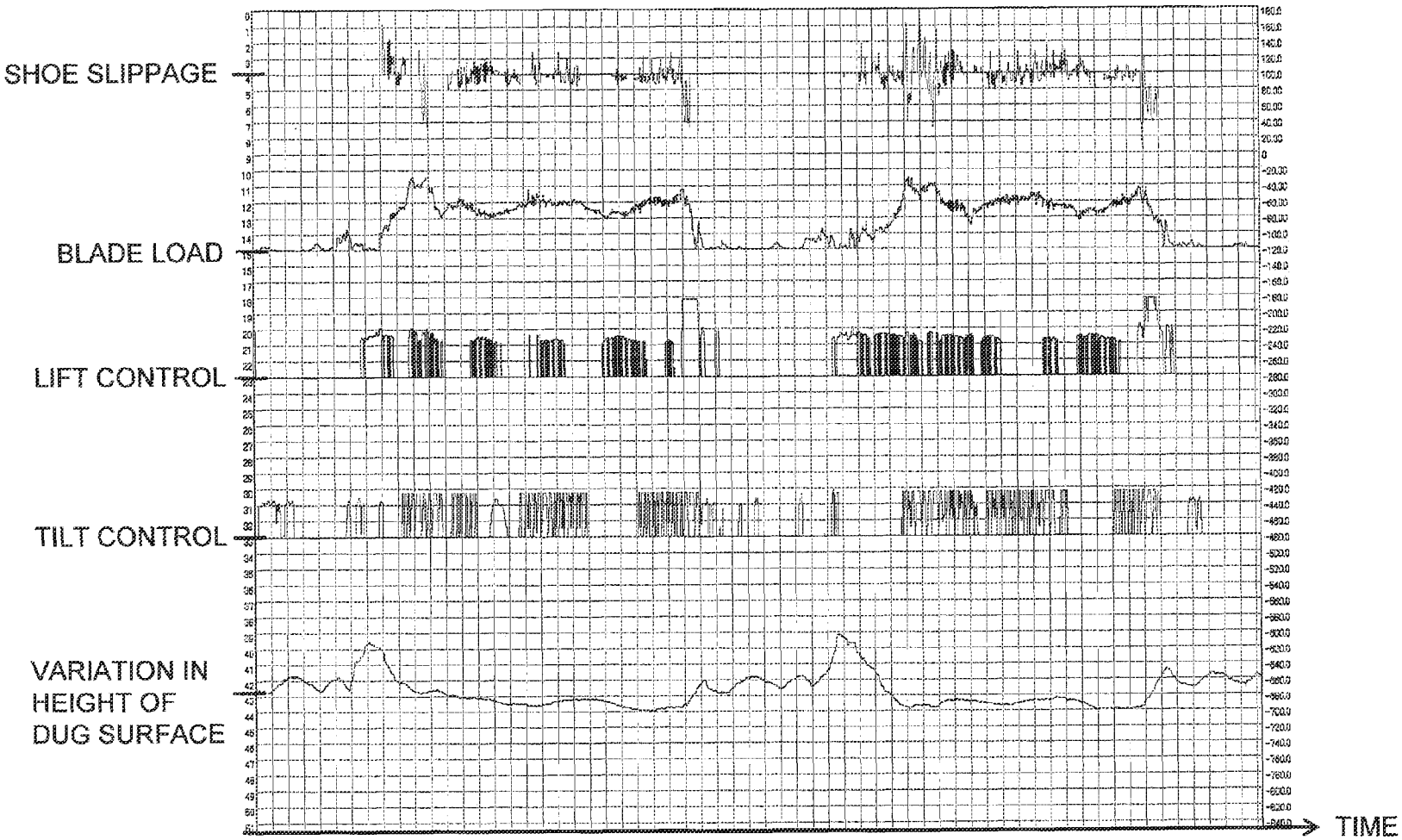
FIG. 9 is a chart representing variation in height of the dozed surface in dozing with a combination of the lift control and a tilt control.

Now, FIG. 8 is a chart representing variation in height of the dozed surface when dozing is executed by a well-known lift control. FIG. 9 is a chart representing variation in height of the dozed surface when dozing is executed by the tilt control and the lift control according to the present exemplary embodiment. As is obvious from comparison between variations in height in FIGS. 8 and 9, it is confirmed that the dozed surface could be inhibited from being formed in a wavy shape when dozing is executed by the tilt control. Further, as is obvious from the driving conditions of the respective cylinders in FIG. 9, it is found that the dozed surface could be further inhibited from being formed in a wavy shape in time ranges when frequency of the lift control is reduced in conjunction with execution of the tilt control.

(2) The blade controller 210 is configured to increase a period of time to supply the hydraulic oil for increasing the tilt range in proportion to magnitude of the blade load F.

Therefore, the blade load F can be more efficiently reduced when the blade load F is greater.

(3) The blade controller 210 is configured to increase the open ratio of the proportional control valve 240 for increasing the tilt speed in proportion to magnitude of the blade load F.

Therefore, the blade load F can be more efficiently reduced when the blade load F is greater.

(4) The blade controller 210 is configured to supply the hydraulic oil to the lift cylinder 50 for elevating the lift frame 30 when excessive shoe slippage occurs in the drive unit 20.

Therefore, excessive shoe slippage can be promptly inhibited even when excessive shoe slippage abruptly occurs due to change of the road surface condition.

(5) The blade controller 210 is configured to perform the rightward tilt action first when the vehicle body 10 turns leftwards, whereas the blade controller 210 is configured to perform the leftward tilt action first when the vehicle body 10 turns rightwards.

Therefore, it is possible to correct orientation of the vehicle body 10 displaced from the travel direction on the onset of the tilt action.

Other Exemplary Embodiments

The exemplary embodiment of the present invention has been explained above, but the present invention is not limited to the aforementioned exemplary embodiment, and a variety of changes can be herein made without departing from the scope of the present invention.

(A) A variety of numeric values specified in the aforementioned exemplary embodiment is exemplary only, and may be arbitrarily set.

(B) Although not particularly described above, the aforementioned tilt action and/or the aforementioned lift action may be configured to be prevented from being executed during a steering operation of an operator.

(C) Although not particularly described above, a normal tilt action and/or a normal lift action based on an operator's operation may be configured to be executed separately from the aforementioned tilt action and/or the aforementioned lift action. In this case, the tilt action and/or the lift action based on the blade controller 210 may be added to the tilt action and/or the lift action based on the operator's operation.

(D) In the aforementioned exemplary embodiment, the blade load is configured to be calculated based on the driving torque data, but the calculation method of the blade load is not limited to the above. For example, the blade load can be obtained by multiplying engine torque by a sprocket wheel diameter and a reduction ratio in a transmission, a steering mechanism and a final reduction gear.

(E) In the aforementioned exemplary embodiment, the bulldozer has been explained as an exemplary "construction machine", but the construction machine is not limited to the bulldozer, and may be any suitable construction machines such as a motor grader.

(F) In the aforementioned exemplary embodiment, the blade controller 210 is configured to cause the blade 40 to perform the rightward tilt action and the leftward tilt action once, but the blade controller 210 may be configured to further execute the rightward tilt action and/or the leftward tilt action.

DESCRIPTION OF THE NUMERALS

10 . . . vehicle body, 11 . . . cab, 12 . . . engine compartment, 20 . . . drive unit, 30 . . . lift frame, 40 . . . blade, 50 . . . lift cylinder, 60 . . . angling cylinder, 70 . . . tilt cylinder, 80 . . . GPS receiver, 90 . . . pair of sprocket wheels, 95 . . . driving torque sensor, 100 . . . bulldozer, 200 . . . blade control system, 210 . . . blade controller, 220 . . . rotation speed sensor, 230 . . . steering, direction detector, 240 . . . proportional control valve, 250 . . . hydraulic pump, ΔS . . . grip ratio, Sr . . . actual vehicle speed, St . . . theoretical vehicle speed, F . . . blade load, W . . . vehicle weight of the bulldozer 100

What is claimed is:

1. A blade control system, comprising:

a lift frame vertically pivotably attached to a vehicle body;

a blade attached to a tip of the lift frame;

a tilt cylinder connected to the lift frame and the blade, the tilt cylinder configured to cause the blade to perform a rightward tilt action and a leftward tilt action;

a determining part configured to determine whether or not a load acting on the blade exceeds a first threshold; and a tilt controlling part configured to supply a hydraulic oil to the tilt cylinder for causing the blade to alternately perform the rightward tilt action and the leftward tilt action when the determining part determines that the load acting on the blade exceeds the first threshold.

2. The blade control system according to claim 1, further comprising:

a tilt action time setting part configured to set an execution time of causing the blade to perform the rightward tilt action and the leftward tilt action to be longer in proportion to magnitude of the load, wherein the tilt controlling part is configured to cause the blade to perform the rightward tilt action and the leftward tilt action in accordance with the execution time set by the tilt action time setting part.

3. A construction machine, comprising:

a vehicle body; and the blade control system according to claim 1.

4. The construction machine according to claim 3, further comprising:

a drive unit including a pair of tracks attached to the vehicle body.

5. A blade control system, comprising:

a lift frame vertically pivotably attached to a vehicle body;

a blade attached to a tip of the lift frame;

a tilt cylinder connected to the lift frame and the blade, the tilt cylinder configured to cause the blade to perform a rightward tilt action and a leftward tilt action;

a determining part configured to determine whether or not a load acting on the blade exceeds a first threshold;

a tilt controlling part configured to supply a hydraulic oil to the tilt cylinder for causing the blade to perform the rightward tilt action and the leftward tilt action when the determining part determines that the load acting on the blade exceeds the first threshold; and a steering direction detector configured to detect a steering direction of the vehicle body based on a yaw angle of the vehicle body, the tilt controlling part being configured to cause the blade to start performing the rightward tilt action first when the steering direction detector detects that the steering direction of the vehicle body is left, and the tilt controlling part being configured to cause the blade to start performing the leftward tilt action first when the steering direction detector detects that the steering direction of the vehicle body is right.

6. A blade control system, comprising:

a lift frame vertically pivotably attached to a vehicle body;

a blade attached to a tip of the lift frame;

a tilt cylinder connected to the lift frame and the blade, the tilt cylinder configured to cause the blade to perform a rightward tilt action and a leftward tilt action;

a determining part configured to determine whether or not a load acting on the blade exceeds a first threshold;

a tilt controlling part configured to supply a hydraulic oil to the tilt cylinder for causing the blade to perform the rightward tilt action and the leftward tilt action when the determining part determines that the load acting on the blade exceeds the first threshold;

a proportional control valve configured to supply the hydraulic oil to the tilt cylinder; and an opening ratio setting part configured to set an opening ratio of the proportional control valve based on the load, the opening ratio setting part being configured to set the opening ratio to be greater in proportion to magnitude of the load, and the tilt controlling part being configured to control the proportional control valve in accordance with the opening ratio set by the opening ratio setting part.

7. A blade control system, comprising:

a lift frame vertically pivotably attached to a vehicle body;

a blade attached to a tip of the lift frame;

a tilt cylinder connected to the lift frame and the blade, the tilt cylinder configured to cause the blade to perform a rightward tilt action and a leftward tilt action;

a determining part configured to determine whether or not a load acting on the blade exceeds a first threshold;

a tilt controlling part configured to supply a hydraulic oil to the tilt cylinder for causing the blade to perform the rightward tilt action and the leftward tilt action when the determining part determines that the load acting on the blade exceeds the first threshold;

a theoretical vehicle speed obtaining part configured to obtain a theoretical vehicle speed of the vehicle body;

an actual vehicle speed obtaining part configured to obtain an actual vehicle speed of the vehicle body;

a lift cylinder configured to vertically pivot the lift frame; and a lift controlling part configured to supply the hydraulic oil to the lift cylinder for elevating the blade when a ratio of the actual vehicle speed to the theoretical vehicle speed is less than a second threshold.

8. A blade control method, comprising:

determining whether or not a load acting on a blade exceeds a first threshold, the blade attached to a tip of a lift frame, the lift frame vertically pivotably attached to a vehicle body, and causing the blade to alternately perform a rightward tilt action and a leftward tilt action when the load acting on the blade is determined to exceed the first threshold.

9. The blade control method according to claim 8, further comprising:

causing the blade to alternately perform the rightward tilt action and the leftward tilt action at a tilt range to be increased in proportion to magnitude of the load.

10. The blade control method according to claim 8, further comprising:

causing the blade to alternately perform the rightward tilt action and the leftward tilt action at a tilt speed to be increased in proportion to magnitude of the load.

* * * * *